US005226811A

United States Patent [19]

Kawamura

[11] Patent Number: 5,226,811

[45] Date of Patent: Jul. 13, 1993

[54] OIL BURNER

[75] Inventor: Masanori Kawamura, Kuwana, Japan

[73] Assignee: Toyotomi Co., Ltd., Japan

[21] Appl. No.: 842,969

[22] Filed: Feb. 28, 1992

[30] Foreign Application Priority Data

Feb. 28, 1991 [JP] Japan ..... 3-17812[U]

[51] Int. Cl.[5] ..... F23D 3/02

[52] U.S. Cl. ..... 431/302; 126/83; 126/96

[58] Field of Search ..... 126/96, 93, 92 B, 92 R, 126/92 AC, 89, 95, 83; 431/302, 307, 308

[56] References Cited

U.S. PATENT DOCUMENTS

| | | | |
|---|---|---|---|
| 1,592,041 | 7/1926 | Morrow | 126/96 |
| 4,653,464 | 3/1987 | Kojima et al. | 126/96 |
| 4,834,064 | 5/1989 | Takashima et al. | 126/96 |
| 4,919,120 | 4/1990 | Horikoshi et al. | 126/92 B |
| 4,926,839 | 5/1990 | Sugawara et al. | 126/96 |

FOREIGN PATENT DOCUMENTS 15885 9/1975 Japan .

*Primary Examiner*—James C. Yeung

*Attorney, Agent, or Firm*—Pollock, Vande Sande & Priddy

[57] ABSTRACT

An oil burner capable of being prevented from being locally heated by combustion in a combustion cylinder structure. A guide plate is arranged at an upper region in a housing of the oil burner for guiding combustion gas emitted from the combustion cylinder structure toward a front opening of the housing. Also, a baffle is connected to a front portion of the guide plate so as to downward extend therefrom, to thereby divert combustion gas in both lateral directions. The baffle plate is formed at a portion thereof, except a central portion thereof, with through-holes or cutouts through which the diverted combustion gas is discharged forwardly and outwardly from the oil burner.

11 Claims, 3 Drawing Sheets

OIL BURNER

BACKGROUND OF THE INVENTION

This invention relates to an oil burner such as an oil-fired space heater, and more particularly to an oil burner of the type that combustion gas produced by combustion in the oil burner and heated air are guided toward a front opening of a housing of the oil burner.

There has been widely known and used an oil burner which includes a combustion cylinder structure and a rear reflection plate and is adapted to outward discharge, through a front opening of the oil burner, heat rays emitted from the combustion cylinder structure and guide heated air and combustion gas to the front opening of the oil burner. The oil burner is provided therein with a guide plate, which is generally arranged above the combustion cylinder structure. Unfortunately, such arrangement of the guide plate causes a portion of the guide plate right above the combustion cylinder structure to be locally heated, so that a portion of a top plate of a housing positioned above a central portion of the front opening is particularly heated to an elevated temperature. In order to avoid the problem, it is attempted that a front end of the cover plate is downward bent or provided with a fin for varying an angle of discharge of combustion gas, to thereby forward direct the flow of combustion gas, and render the temperature distribution to the guide plate and top plate substantially uniform, as disclosed in Japanese Utility Model Publication No. 15885/1975.

Recently, the down-sizing and high calorie outputting of an oil burner has been well in progress, therefore, it is highly desired to eliminate the above-described local heating of the top plate and guide plate. For example, the UL safety standard in the United states defines a doping test requiring that when combustion takes place in an oil burner while covering the oil burner with gauze-like cloth, the cloth fails to ignite within 30 seconds from the start of combustion. Also, the Japanese Industrial Standard (JIS) defines a wind-resistance test which requires that a combustion flame fails to get out of an oil burner when wind of a predetermined velocity is caused to blow against the oil burner. The doping test and wind-resistance test are generally unfavorable to a down-sized oil burner.

SUMMARY OF THE INVENTION

The present invention has been made in view of the foregoing disadvantage of the prior art.

Accordingly, it is an object of the present invention to provide an oil burner which is capable of preventing any portion of the oil burner from being locally undesirably heated by combustion in a combustion cylinder structure.

It is another object of the present invention to provide an oil burner which is capable of being significantly down-sized while being prevented from being locally heated.

It is a further object of the present invention to provide an oil burner which is capable of discharging combustion gas at substantially uniform temperature distribution.

It is still another object of the present invention to provide an oil burner which is capable of preventing a top plate of a housing of the oil burner from being locally heated.

It is yet another object of the present invention to provide an oil burner which is capable of ensuring safe combustion operation.

It is a still further object of the present invention to provide an oil burner which is capable of accomplishing the above-described objects with a simple construction.

In accordance with the present invention, an oil burner is provided. The oil burner includes a housing formed at a front portion thereof with an opening, and a combustion cylinder structure and a rear reflection plate arranged in the housing. A guide plate is arranged at an upper region in the housing for guiding combustion gas emitted from the combustion cylinder structure toward the front opening of the housing. Also, a baffle is connected to a front portion of the guide plate so as to downward extend therefrom. The baffle is formed at a portion thereof, except a central portion thereof, with a gas passing means.

In a preferred embodiment of the present invention, the baffle is formed into a plate-like shape.

In a preferred embodiment of the present invention, the gas passing means is arranged on both sides of the baffle.

In a preferred embodiment of the present invention, the gas passing means may comprise through-holes formed at the baffle plate. Alternatively, the gas passing means may comprise cutouts formed at the baffle plate.

In a preferred embodiment of the present invention, the baffle has a height of 15 to 30 mm.

In a preferred embodiment of the present invention, the oil burner further comprises a heat shielding plate arranged between the guide plate and a top plate of the housing to define an air passage communicating with an ambient atmosphere.

BRIEF DESCRIPTION OF THE DRAWINGS

These and other objects and mary of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, an oil burner according to the present invention will be described hereinafter with reference to the accompanying drawings.

Figure 1:
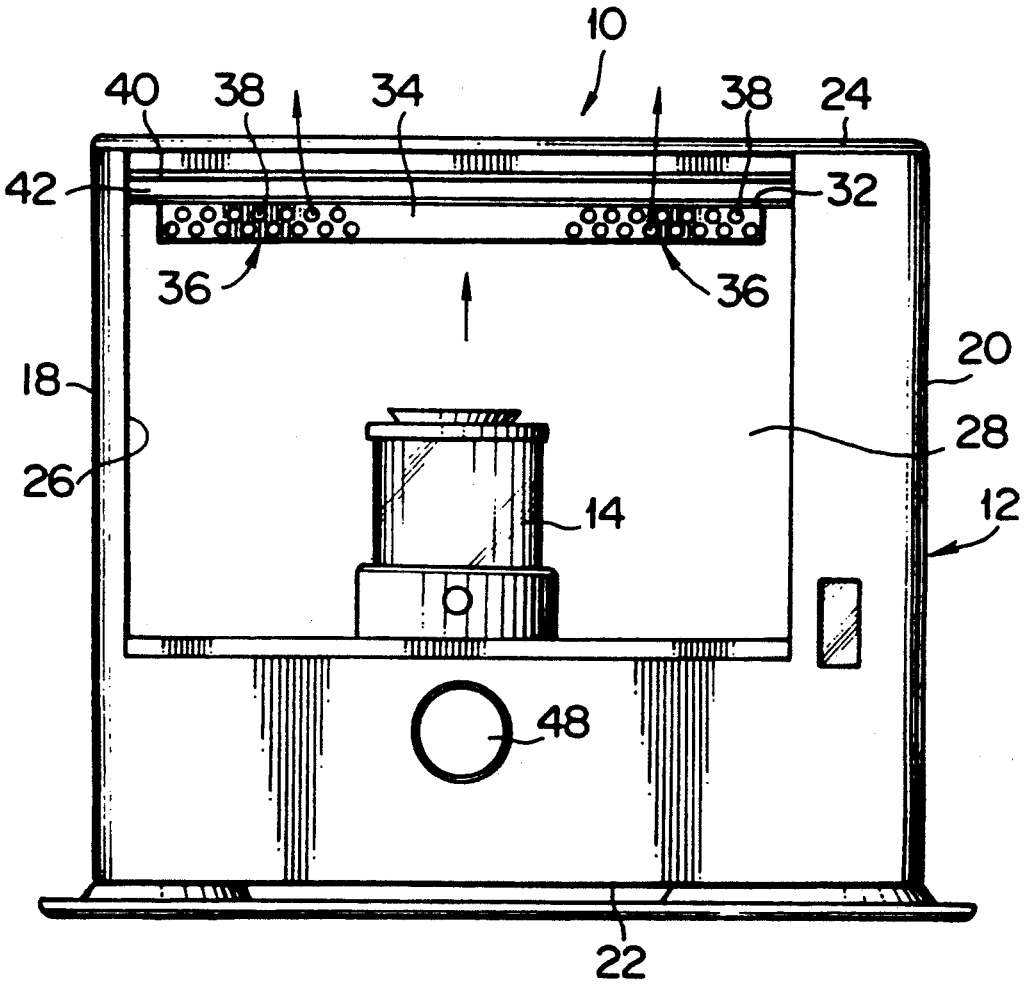
FIG. 1 is a front elevation view showing an embodiment of an oil burner according to the present invention in which a protective guard is removed for the sake of brevity.
Figure 2:
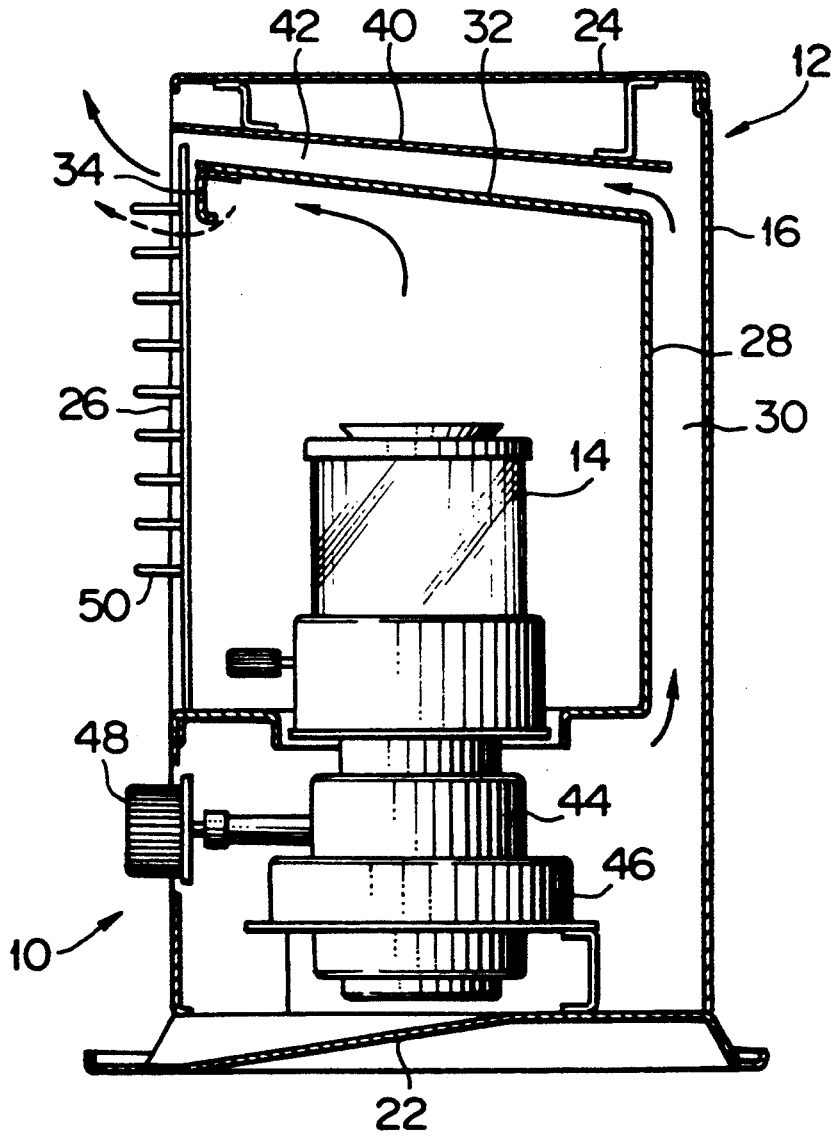
FIG. 2 is a vertical sectional side elevation view of the oil burner shown in FIG. 1.

FIGS. 1 and 2 show an embodiment of an oil burner according to the present invention. An oil burner of the illustrated embodiment generally designated at reference numeral 10 is constructed in the form of an oil-fired space heater. The oil burner 10 includes a housing 12, in which a combustion cylinder structure 14 is arranged. The housing 12 includes a rear plate 16 (FIG. 2), both side plates 18 and 20 (FIG. 1), a bottom plate 22, and a top plate 24 which are connected to each other, so that the housing 12 is provided at a front portion thereof with an opening 26. The housing 12 may be integrally formed. In the so-constructed housing 12 is also arranged a rear reflection plate 28 in a manner to be positioned behind the combustion cylinder structure 14 or between the combustion cylinder structure 14 and the rear plate 16 of the housing 12, so that a first or vertically extending passage 30 communicating through a lower portion of the housing 12 of the oil burner 10 with an ambient atmosphere is defined between the rear plate 16 of the housing 12 and the reflection plate 28. To an upper end of the rear reflection plate 28 is connected a guide plate 32. More particularly, the guide plate 32 is connected at a rear end thereof to the reflection plate 28 in a manner to obliquely upward extend therefrom toward a front portion of the housing 12 or the opening 26 of the oil burner 10 and more specifically toward an upper portion of the opening 26 of the housing 12, so that combustion gas of an elevated temperature produced due to combustion of fuel oil such as kerosene in the combustion cylinder structure 14 and upward emitted therefrom is guided along a lower surface of the guide plate 32 to the opening 26 of the housing 12, so that it is discharged from the opening 26 to an ambient atmosphere. In the illustrated embodiment, the guide plate 32 is formed integral with the rear reflection plate 28.

The guide plate 32 is mounted on a front portion thereof with a baffle 34, which is arranged so as to downward extend from the front portion of the guide plate 32. In the illustrated embodiment, the baffle 34 is in the form of a laterally extending elongated plate defining a channel of generally C-shaped cross section as shown in FIG. 2. The baffle plate 34 is formed at a portion thereof except a central portion thereof or both side portions thereof with a gas passing means 36 which, in the illustrated embodiment, comprises through-holes 38. Thus, combustion gas forward guided along the lower surface of the guide plate 32 toward the front portion of the oil burner 10 collides with a central portion of a rear surface of the baffle plate 34, resulting in being separated or diverted in both lateral directions. Then, the combustion gas is outward discharged via the through-holes 38.

Figure 3:
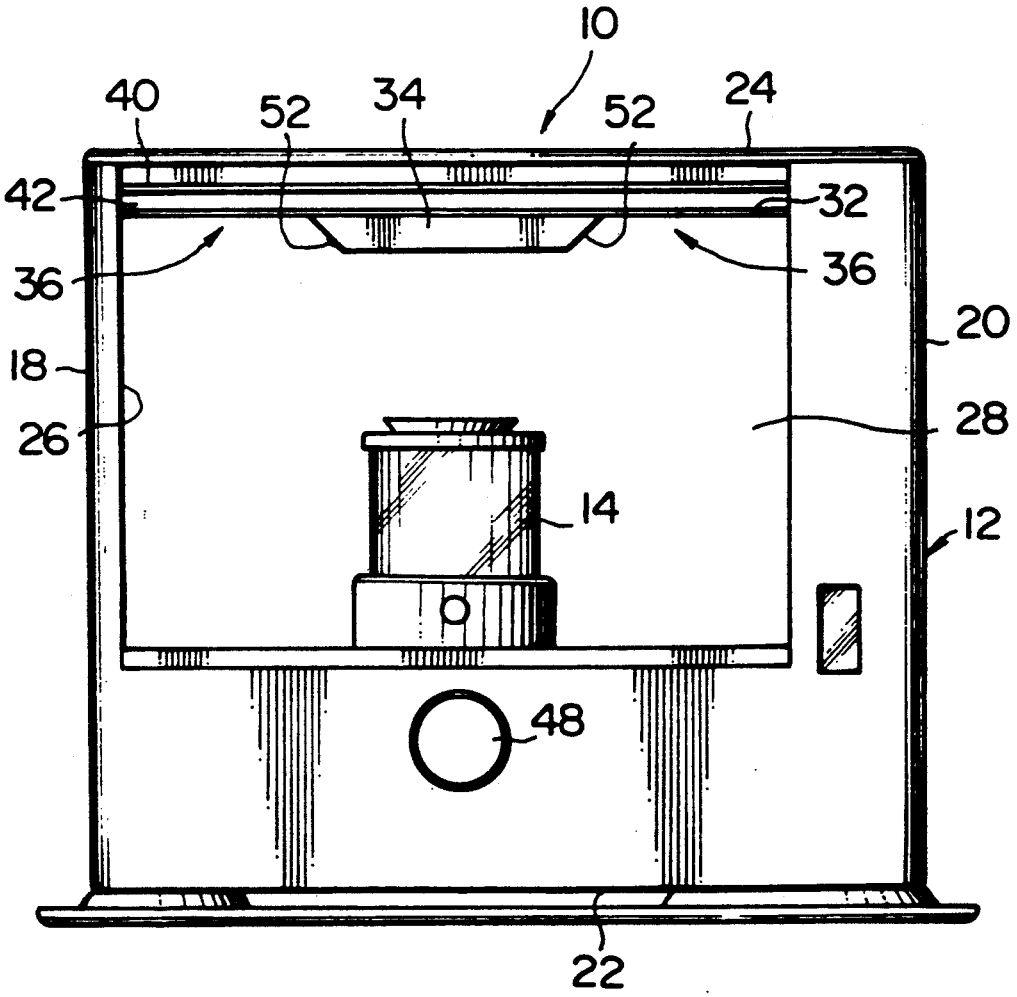
FIG. 3 is a fragmentary front elevation view showing another embodiment of an oil burner according to the present invention.

It was found that the baffle plate 34 is preferably formed into a vertical length or height of about 15 to 30 mm. The height below 15 mm tends to cause the amount of combustion gas discharged under a distal or lower edge of the central portion of the baffle plate 34 which is not formed with the through-holes 38 to be larger than that diverted by the baffle plate 34 and then discharged through the gas passing means 36, whereas the height above 30 mm tends to cause substantially all combustion gas to be discharged through the gas passing means 36; thus, it will be noted the height of the baffle plate 34 out of the range between 15 mm and 30 mm deteriorates a uniform temperature distribution function of the baffle plate 34. Further, formation of the baffle plate 34 into an excessive height causes an aesthetic appearance of the oil burner to be deteriorated. The lateral extent of the solid central portion of the baffle plate 34 may be greater than the lateral extent of the combustion cylinder structure 14 as shown in FIGS. 1 and 3.

Between the top plate 24 and the guide plate 32 is arranged a heat shielding plate 40 in a manner to define a second or lateral passage 42 between the guide plate 32 and the heat shielding plate 40 so as to communicate with the first or vertical passage 30. Such construction permits a draft of air generated in the first or vertical passage 30 by heat of combustion carried out in the combustion cylinder structure 14 to be directed to the second passage 42, to thereby cool the guide plate 32 and heat shielding plate 40.

The remaining part of the illustrated embodiment may be constructed in substantially the same manner as such a conventional oil burner as widely known in the art and described above. The combustion cylinder structure 14 is mounted on a wick receiving structure 44, which is then mounted on an oil reservoir 46 for storing fuel oil such as kerosene therein. Reference numeral 48 designates a wick operating handle operatively connected to the wick receiving structure 44 for vertically moving a wick (not shown) arranged in the structure 44. Reference numeral 50 designates a guard (FIG. 2), which is omitted in FIG. 1 for the sake of brevity.

Now, the manner of operation of the oil burner of the illustrated embodiment will be described hereinafter with reference to FIGS. 1 and 2.

When combustion is started in the combustion cylinder structure 14 in such a manner as widely known in the art, combustion heat emitted from the combustion cylinder structure 14 together with combustion gas is reflected by the reflection plate 28, to thereby forwardly discharged from the oil burner through the front opening 26. The combustion gas rises and abuts against the guide plate 32, resulting in it being forwardly guided along the lower surface of the guide plate 32. The guide plate 32, as described above, is provided at the front portion thereof with the baffle plate 34, so that the combustion gas is then diverted in both lateral directions and forwardly discharged through the gas passing means 36 comprising the though-holes 38. Thus, combustion gas is prevented from being directly discharged through the front opening 26 to an ambient atmosphere. Substitutionally, the combustion gas is caused to spread all over the lower surface of the guide plate 32 and stay there for a short period of time, so that the guide plate 32 may be heated wholly rather than at a portion thereof immediately above the combustion cylinder structure 14, to thereby be prevented from locally or partially heated. Thus, the guide plate 32 may be much more uniformly heated.

Such a uniform increase in temperature all over the guide plate 32 permits a temperature of the combustion gas to be lowered. Also, the above-described arrangement of the baffle plate 34 in the illustrated embodiment permits the amount of combustion gas diverted by the baffle plate 34 and then discharged through the gas passing means 36 to be larger than the amount of combustion gas discharged under the distal or lower edge of the central portion of the baffle plate which is not formed with the through-holes 38. This results in the combustion gas guided along the guide plate 32 being discharged from the whole upper portion of the opening 26, to thereby prevent a front end or edge of the top plate 24 of the frame 12 from being locally heated and wholly decrease a temperature of the front end.

Also, the construction of the illustrated embodiment that the heat shielding plate 40 is arranged between the top plate 24 of the housing 12 and the guide plate 32 to define the second or lateral passage 42 between the guide plate 32 and the heat shielding plate 40 in a manner to communicate with the first or vertical passage 30 permits air introduced from an ambient atmosphere through the lower portion of the oil burner into the first passage 30 to be guided to the second or lateral passage 42 due to a draft formed in the passage 30, so that the air cools the guide plate 32 and heat shielding plate 40. This permits heat dissipation of the guide plate 32 &o be promoted to effectively prevent the top plate 24 and the like from being locally or partially heated.

FIG. 3 shows another embodiment of an oil burner according to the present invention. In an oil burner 10 of the illustrated embodiment, a gas passing means 36 comprises cutouts 52 formed on both sides of a baffle 34 which is likewise formed into a plate-like shape. It will be readily noted that the cutouts 52 exhibits substantially the same function as the through-holes 38 in the above-described embodiment. The remaining part of the illustrated embodiment may constructed in substantially the same manner as the embodiment described above.

In the embodiments described above, the gas passing means 36 comprises the through-holes 38 or cutouts 52. Employment of either the through-holes 38 or the cutouts 52 may be suitably selected depending upon a whole design of the oil burner, its manufacturing cost and the like. For example, when importance is attached to a decrease in manufacturing cost, the cutouts 52 would be selected; whereas consideration of the design would lead to selection of the through-holes 38.

As can be seen from the foregoing, in the oil burner of the present invention, the arrangement of the baffle prevents combustion gas upward emitted from the combustion cylinder structure from being directly discharged forwardly and downwardly by the guide plate, and instead causes the combustion gas to stay all over the lower surface of the guide plate for a short period of time and be diverted in both lateral directions. Then, the combustion gas is forward discharged from the oil burner through the gas passing means. Although this causes the whole top plate to be increased in temperature, a maximum temperature of a portion of the top plate right above the combustion cylinder structure is permitted to be reduced.

Thus, the combustion gas is uniformly dispersed in the upper portion of the oil burner without being locally concentrated, and is somewhat cooled by the baffle, resulting in it being discharged from the oil burner at a low temperature as compared with the prior art, so that the oil burner of the present invention may satisfactorily pass the doping test defined in UL. More specifically, such construction of the present invention permits an oil burner to pass the test even when it carries out combustion increased by 10% as compared with its rated combustion.

Further, it was proved that even when the oil burner is caused to form an excessively increased combustion flame rising from the combustion cylinder construction in the above-described wind-resistance test defined in JIS, the baffle exhibits a flame control function of effectively preventing the flame from outwardly getting out of the housing of the oil burner.

In addition, the arrangement of the heat shielding plate between the guide plate and the top plate of the housing substantially shields the top plate of the housing from combustion heat. Also, the arrangement permits the second passage to be defined between the guide plate and the heat shielding plate, which functions to pass air therethrough, to thereby cool the top plate of the housing and the guide plate, resulting in safety of the oil burner being further promoted.

Thus, it will be noted that the oil burner of the present invention exhibits satisfactory safety with a simple construction.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An oil burner comprising:

a housing formed at a front portion thereof with an opening;

a combustion cylinder structure and a rear reflection plate arranged in said housing;

a guide plate arranged at an upper region in said housing and extending obliquely upward from said rear reflection plate and over said combustion cylinder structure toward said front portion of said housing to guide combustion gas emitted from said combustion cylinder structure toward said front opening of said housing; and, baffle means having an upper section connected to a front portion of said guide plate, an intermediate section extending downwardly from said oblique guide plate, and a lower section extending rearwardly toward said reflecting plate to define a laterally extending channel of generally C-shaped cross section for diverting laterally a sufficient part of said combustion gas to prevent substantial local overheating of said guide plate;

the intermediate section of said baffle means comprising a solid central portion without gas passing means and of greater lateral extent than height, and lateral portions with gas passing means arranged on opposite sides of said solid central portion, the height and lateral extent of said solid central portion being sufficient to divert said diverted part of said combustion gas in both lateral directions such that said diverted part is discharged through the gas passing means of both of said lateral portions to an ambient atmosphere outside of said housing.

2. An oil burner as defined in claim 1, wherein said intermediate section is formed into a plate-like shape.

3. An oil burner as defined in claim 2, wherein said gas passing means comprises through-holes.

4. An oil burner as defined in claim 2, wherein said gas passing means comprises cutouts.

5. An oil burner as defined in claim 4, wherein said intermediate section has a height of 15 to 30 mm.

6. An oil burner as defined in claim 3, wherein said intermediate section has a height of 15 to 30 mm.

7. An oil burner as defined in claim 1, further comprising a heat shielding plate arranged between said guide plate and a top plate of said housing to define an air passage communicating with said ambient atmosphere.

8. An oil burner as defined in claim 1, wherein the height and lateral extent of said central portion is such that the amount of said sufficient combustion gas part is larger than the amount of a second part of said combustion gas discharged to said ambient atmosphere under a lower edge of said central portion.

9. An oil burner as defined in claim 1, wherein the lateral extent of said central portion is greater than the lateral extent of said combustion cylinder structure.

10. An oil burner as defined in claim 1, wherein said guide plate is integral with said rear reflection plate.

11. An oil burner as defined in claim 1, wherein the intermediate section of said baffle means has a plate-like form and is disposed substantially vertically.

* * * * *